US008651242B2

(12) United States Patent
Sarjanen et al.

(10) Patent No.: US 8,651,242 B2
(45) Date of Patent: Feb. 18, 2014

(54) ELEVATOR SYSTEM WITH FREELY LOCATABLE CALL TERMINAL

(75) Inventors: Jukka-Pekka Sarjanen, Vantaa (FI); Tuomas Susi, Helsinki (FI); Niko Elomaa, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/598,085

(22) Filed: Aug. 29, 2012

(65) Prior Publication Data

US 2012/0318617 A1 Dec. 20, 2012

Related U.S. Application Data

(63) Continuation of application No. PCT/FI2011/050211, filed on Mar. 11, 2011.

(30) Foreign Application Priority Data

Mar. 12, 2010 (FI) ..... 20100112

(51) Int. Cl.
*B66B 1/16* (2006.01)

(52) U.S. Cl.
USPC ..... 187/388; 187/396; 187/391

(58) Field of Classification Search
USPC ..... 187/247, 380–388, 391–393, 396
See application file for complete search history.

(56) References Cited

U.S. PATENT DOCUMENTS 5,832,363 A 11/1998 Moriya et al.
6,108,535 A 8/2000 Moriya et al.
6,202,799 B1 * 3/2001 Drop ..... 187/388
6,223,160 B1 * 4/2001 Kostka et al. ..... 704/275
6,868,945 B2 * 3/2005 Schuster et al. ..... 187/380
6,986,408 B2 * 1/2006 Takeuchi ..... 187/380
7,353,915 B2 * 4/2008 Zaharia et al. ..... 187/388
7,377,364 B2 * 5/2008 Tyni et al. ..... 187/396
7,559,408 B2 * 7/2009 Flynn et al. ..... 187/396

(Continued)

FOREIGN PATENT DOCUMENTS

EP 1943175 A1 7/2008
JP 1214593 A 8/1989

(Continued)

OTHER PUBLICATIONS

International Search Report.

(Continued)

*Primary Examiner* — Anthony Salata
(74) *Attorney, Agent, or Firm* — Harness, Dickey & Pierce, P.L.C.

(57) ABSTRACT

In a method for adapting control functions in elevator systems using portable call terminals for providing calls, values of the control parameters are set and then used in the control of the elevator system. The values of the control parameters are dependent on the location of the call terminals. An elevator system includes: at least one elevator; at least one freely locatable call terminal; and a control system responsive to the call terminal. The control system is configured to control the elevator system based on at least one control parameter. A value of the control parameter is determined based on a location of the call terminal within a building after the portable call terminal is arranged at the location.

16 Claims, 1 Drawing Sheet

(56) References Cited

U.S. PATENT DOCUMENTS

| | | | | |
|---|---|---|---|---|
| 7,849,974 | B2 * | 12/2010 | Stanley et al. | 187/387 |
| 8,028,806 | B2 * | 10/2011 | Stanley et al. | 187/387 |
| 8,028,809 | B2 * | 10/2011 | Blackaby et al. | 187/391 |
| 8,047,333 | B2 * | 11/2011 | Finschi | 187/382 |
| 8,136,636 | B2 * | 3/2012 | Bahjat et al. | 187/391 |
| 8,151,942 | B2 * | 4/2012 | Rusanen et al. | 187/247 |
| 2007/0246306 | A1 | 10/2007 | Tschuemperlin et al. | |
| 2008/0011557 | A1 | 1/2008 | Hakala et al. | |
| 2008/0264731 | A1 | 10/2008 | Mangini et al. | |
| 2010/0147630 | A1 | 6/2010 | Demma | |

FOREIGN PATENT DOCUMENTS

| | | | |
|---|---|---|---|
| JP | 2005280906 | A | 10/2005 |
| WO | WO-02066357 | A1 | 8/2002 |
| WO | WO-2006082273 | A1 | 8/2006 |
| WO | WO-2007040532 | A1 | 4/2007 |
| WO | WO-2008122669 | A2 | 10/2008 |

OTHER PUBLICATIONS

Written Opinion of the International Searching Authority.

* cited by examiner

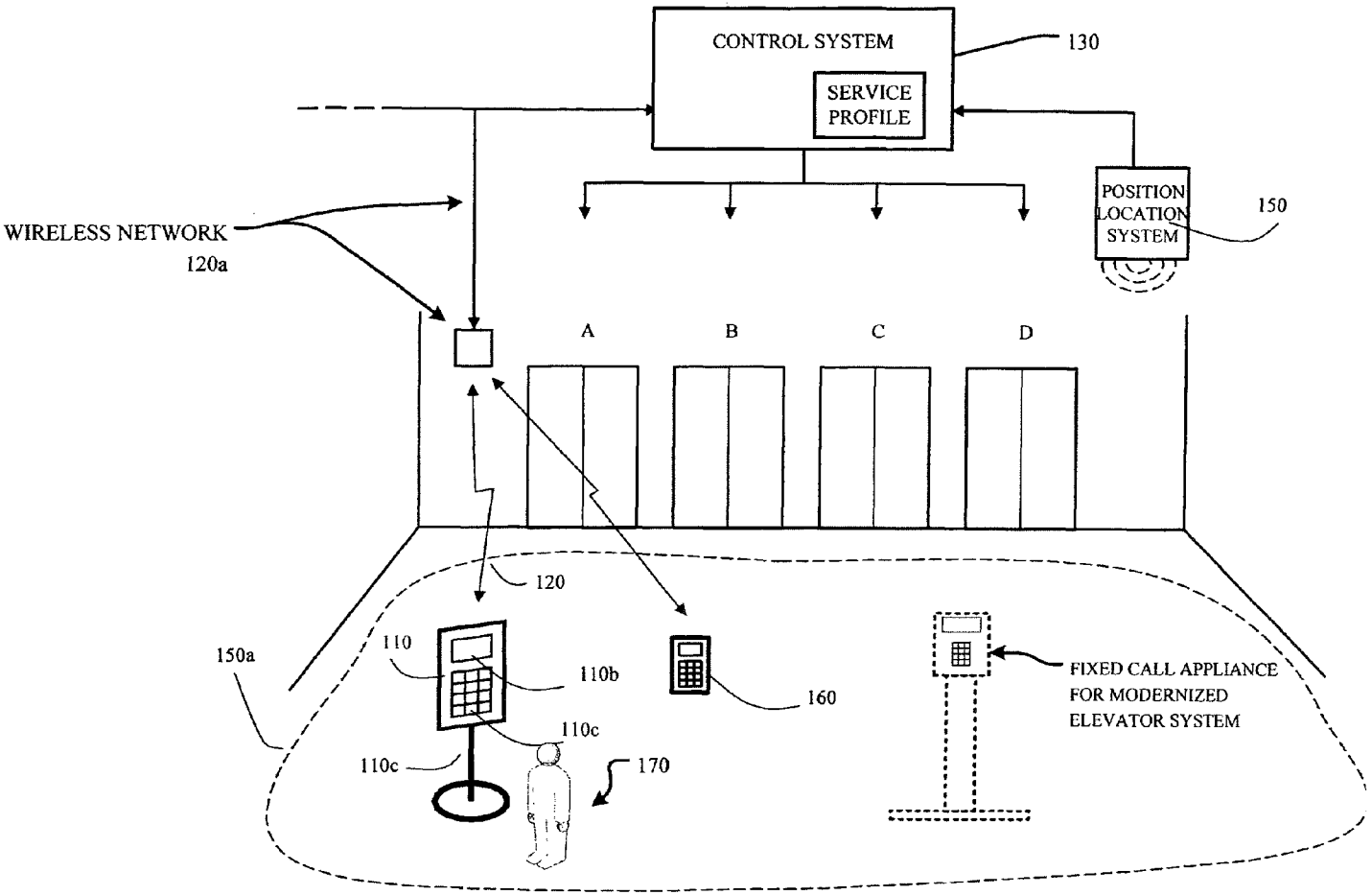
CONTROL SYSTEM
SERVICE PROFILE
130
POSITION LOCATION SYSTEM
150
A
B
C
D
FIXED CALL APPLIANCE FOR MODERNIZED ELEVATOR SYSTEM
160
170
110b
110c
120
110
110c
150a
WIRELESS NETWORK
120a

ELEVATOR SYSTEM WITH FREELY LOCATABLE CALL TERMINAL

CROSS REFERENCE TO RELATED APPLICATIONS

This application is a continuation of International Application Number PCT/FI2011/050211 filed Mar. 11, 2011 and claims priority to Finish Application Number 20100112 filed Mar. 12, 2010, the entire contents of each of which are hereby incorporated herein by reference.

FIELD OF THE INVENTION

The invention relates to elevator systems. More particularly the invention relates to the adaptation of the operation of an elevator system when using portable call terminals for the giving of calls.

BACKGROUND OF THE INVENTION

In conventional elevator systems the giving of calls occurs with up/down pushbuttons in the elevator lobbies, by means of which pushbuttons a passenger orders an elevator to his/her departure floor and, after the elevator has reached the departure floor, indicates in the elevator car his/her desired destination floor. Alongside the call-giving method in question also so-called destination call systems are used, in which each passenger indicates his/her destination floor already in the elevator lobby before going into the elevator car. The giving of destination calls takes place by means of a special destination call terminal, either with pushbuttons or by means of a personal identifier, e.g. an RFID (radio frequency identifier) tag. Based on the destination call data, the group control of the elevator group allocates an elevator car for the use of the passenger, which is notified to the passenger e.g. on a display in the destination call terminal. In the same connection the passenger can be given guidance information about where the elevator in question is located with respect to the destination call terminal.

The destination call terminals are typically located e.g. in the elevator lobby as fixed installations. A problem with call terminals that are fixed installations is, inter alia, that they adapt poorly to changes occurring in a building, e.g. if the intended use of the building changes or if large numbers of people sporadically visit the building. Call terminals could also have been installed originally in unsuitable locations from the viewpoint of the smooth flow of traffic, in which case the elevator lobbies can become needlessly congested. The addition of fixed call terminals or the retroactive changing of their location is an awkward and expensive procedure because, inter alia, the cabling connecting to the call terminals must generally be disposed inside the floor structures and/or wall structures of the building. One known solution for solving the problems described above is presented in patent application EP1943175, wherein portable destination call terminals are disposed e.g. in elevator lobbies that are congesting. According to the solution, the destination call terminal is provided with a battery or with some other suitable power source and it is able to communicate wirelessly with the group control of an elevator group. The solution does not in any way, however, present the taking into account of the location or distance of the destination call terminals in relation to the elevators of the elevator group. Since the location of portable call terminals is by nature temporary and dynamic, the elevator group should have information about the location of call terminals, or at least the control parameters that have a value dependent on the location of the call terminals should be updated so that the operation of the elevator group could be optimized to correspond to the actual locations of the call terminals. Also the giving of guidance information for guiding a passenger from a call terminal to the elevator serving him/her is fairly impossible if the elevator group does not have information about the location of the call terminal in the building.

AIM OF THE INVENTION

The aim of the present invention is to eliminate or at least to alleviate the aforementioned drawbacks that occur in prior-art solutions. The aim of the invention is also to achieve one or more of the following objectives:

- a solution that is easily adaptable to changing conditions and traffic needs in elevator systems,
- an automatically adaptable/configurable system
- to improve the transportation capacity of elevator systems and to reduce congestion in elevator lobbies,
- to improve access control in a building,
- to improve the guidance to be given to passengers,
- to take into account the needs of different user groups in the elevator services,
- to achieve savings in the installation costs and equipment costs of an elevator system,
- to reduce the number of servicing visits, and
- a solution that facilitates modernizations of elevator systems.

SUMMARY OF THE INVENTION

Methods and elevator systems are provided. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for adapting the control functions in an elevator system, which comprises at least one elevator and at least one freely locatable call terminal, and also a control system responsive to the aforementioned call terminal. In the method a call terminal is disposed in the desired location in the building, after which the values of the control parameters of them are set, which values are dependent on the location of the call terminal and which are used for the control of the elevator system. The aforementioned control parameters are e.g. the walking time parameters to be used in the allocation of an elevator serving a call, which parameters determine the probable transfer times of passengers from the call terminals to the elevators of the elevator system. In one embodiment of the invention the position data of the call terminals is set, on the basis of which the control system calculates the values of the aforementioned control parameters. The position data can also be taken into account when guiding a passenger from a call terminal to the elevator serving him/her. The position data is set and recorded in the elevator system either manually by means of a user interface or automatically by means of a position location system.

The present invention also presents an elevator system, which comprises at least one elevator, at least one freely locatable call terminal and also a control system responsive to the aforementioned call terminal, which uses in the control of the elevator system at least one control parameter, the value of which depends on the location of the call terminal. The elevator system comprises determination means for determining the value of the aforementioned at least one control parameter when the call panel is disposed in the desired location in the building.

In one embodiment of the invention a service profile of the call terminal is set, which takes into account the calls given from a call terminal in the allocation phase and/or the elevators allocated to calls in the control of the elevators. A service profile sets, for example, the floors to which destination calls can be given from a call terminal, the language with which the information is presented by the call terminal, the run parameters of the elevator for taking into account the needs of special groups, such as elderly people, physically handicapped people, et cetera, in the elevator service.

The solution according to the invention can also be applied to the modernizations of elevators by disposing portable call terminals on the floor levels in the starting phase of the modernization and by connecting them to the elevators being modernized. When the modernization progresses to the phase in which passengers have the use of the final (modernized) call-giving appliances, the unneeded call terminals can be removed from use. Alternatively, the portable call terminals can be left on the floor levels as a part of the modernization delivery.

As a result of the invention an elevator system can easily be adapted to changing conditions and traffic needs by disposing portable call terminals on different floor levels according to need. At the same time the optimal operation and transport capacity of the elevator system can be ensured by taking into account in the control of the elevator system the actual location of the call terminals. Congestion of elevator lobbies can also be reduced by placing call terminals in locations that are critical from the viewpoint of traffic and by guiding passenger flows in good time (remotely) to uncongested elevator lobbies. If the desired result is not achieved immediately, the call terminals can easily be moved to a new location for finding the optimal placement in the building. Passengers also receive accurate guidance no matter in which location in the building a call terminal is, as a consequence of which passengers quickly and easily find their way to the elevator/elevator group serving them. No special servicing visits are needed for setting the position data and the values of the other parameters, but instead the necessary procedures can be performed e.g. by a person who works in the building on a daily basis. If a position location system is in use, the elevator system can locate the call terminals automatically and in real-time. In this case the optimal operation of the elevator system can be guaranteed in all situations without the need to perform manual procedures for setting the control parameters. As a result of the service profile, call terminals can be "personalized" for the needs of different user groups by taking into account their special needs in the control of the elevators and by giving guidance or other information targeted specifically at them in connection with the giving of a call. By restricting in the service profile the destination calls of passengers to certain floors, also access control can be improved in buildings. As a result of the invention, the modernization time of elevator systems can be shortened and problem-free switching from conventional up/down calls to destination calls that improve transport capacity is possible already in the starting phase of the modernization. By implementing call-giving on all the floor levels using portable call terminals, savings in the installation costs and equipment costs of an elevator system are achieved because the installation of fixed call terminals is then avoided.

DETAILED DESCRIPTION OF THE INVENTION

FIG. 1 presents an elevator system, in which the solution according to the invention is applied. The elevator system comprises four elevators (A, B, C, A), a control system 130, and also a portable call terminal 110. The call terminal is disposed e.g. in the entrance lobby of floor 1 and is connected to the control system 130 via a wireless data transfer connection 120. Portable call terminals can also be on other floors served by the elevator system, which are connected wirelessly in the manner of call terminal 110 to the control system 130. The elevator system can also comprise conventional call-giving appliances (up/down pushbuttons and/or, destination call terminals) permanently installed on the floor levels, which passengers 170 can use for giving calls on floor levels that do not have portable call terminals 110. In FIG. 1 the wireless data transfer connection 120 is implemented e.g. via a wireless local area network 120*a*, but from the standpoint of the invention any wireless data transfer solution whatsoever that is suited to the purpose is possible. The call terminal 110 "stands" in the entrance lobby supported by a pedestal 11*c*. Since the pedestal is not fixed to the floor, the call terminal can be moved easily from one place to another in the building.

The call terminal 110 comprises pushbuttons 110*a*, for registering destination calls given by passengers 170, and also a display 110*b* for displaying guidance information and other information. Alternatively the call terminal can be provided with a touch-sensitive display, in which case conventional pushbuttons 110*a* are not needed but instead the pushbuttons are graphically presented on the touch-sensitive display. If it is desired to give guidance information and other information also auditively, the call terminal must be provided with auditive signaling means. For producing the electric power needed, the call terminal is provided with e.g. a battery, photocell or other power source suited to the purpose. The display and the other components of the call terminal are preferably low-power components for minimizing electricity consumption. A reading device (not presented in FIG. 1) can also be integrated in connection with a call terminal, which reading device is able to read the data contained in an identifier given into the possession of a passenger 170. The identifier can be e.g. an RFID identifier, a tag comprising a barcode or some other corresponding personal identifier. On the basis of the data contained in an identifier, the control system automatically generates a destination call to the destination floor indicated either directly or indirectly by the identifier.

The functions of the elevator system are controlled by the control system 130, which in this context refers to all those control apparatuses (group control, elevator-specific controls, etc.), that are used for controlling the elevators on the basis of the calls given. When a passenger 170 has given a destination call from a call terminal 110, the call data are transmitted via the wireless data transfer connection 120 to the control system 130, which allocates an elevator (elevator car) for the use of the passenger 170 using some prior-art allocation method, in which the aforementioned walking times can be used as one optimization criterion. Information about the allocated elevator and about its location with respect to the call terminal is transmitted to the call terminal wirelessly via a data transfer connection 120. The information received in the call terminal is presented on the display 110*b* to the passenger 170.

For adapting the functions of the elevator system, control parameters that have a value dependent on the location of the call terminals must be updated to correspond to the actual location of the call terminals. For this purpose the control system 130 in FIG. 1 is connected to a position location system 150, which detects the call terminals 110 that are in the detection area 150*a* and sets their position data automatically. The position location system 150 can be based on any prior-art position location technology whatsoever that is suited to the purpose, and it is not presented in any more detail in this context. The position location system can be a centralized position location system in the manner of FIG. 1 or distributed e.g. such that each call terminal locates its own position data independently and conveys the data to the control system 130. The detection area of the position location system according to FIG. 1 covers at least those floors/areas on/in which it is generally desired to dispose portable call terminals. When a call terminal 110 is disposed in the desired location in the detection area 150*a*, the position location system 150 identifies the call terminal and determines its position data, such as the location floor of the call terminal, the position coordinates of the call terminal on a floor and/or the direction data of the call terminal, which means the angle of rotation of the call terminal around its vertical axis (pedestal) in relation to some known reference direction. The position location system continuously monitors the location of the call terminals, in which case if a call terminal 110 is moved in the detection area 150*a*, either deliberately or accidentally, the position data are updated in the control system automatically. On the basis of the location floor, the control system can deduce from which floor the passenger gave his/her call. On the basis of the position coordinates, the control system can calculate the distances of a call terminal to the different elevators of the elevator system and can estimate on the basis of the distances the probable walking times of passengers from a call terminal to the elevators. On the basis of the direction data and/or the position coordinates, the control system can form and present on the display 110*b* of the call terminal guidance information to the allocated elevator and/or elevator group such that the location of the call terminal at that particular time is taken into account in the guidance. Thus for guiding a passenger, e.g. a direction arrow can be presented on the display, which arrow always points in which direction the allocated elevator is regardless of the location of the call terminal.

If the elevator system is not connected to a position location system described above, the control parameters and/or the position data must be set manually. For this purpose a configuration terminal 160 is presented in FIG. 1 by way of example, using which configuration terminal e.g. a person working in the building can enter the necessary data into the control system 130. The configuration terminal can be any terminal device whatsoever that is suited to the purpose and that is, or can be, connected to the control system, or it can be the call terminal itself. For determining walking times a person can perform one or more "test walks" from the call terminal to the elevators and/or vice versa, from which a sufficiently good time estimate is obtained for the walking time parameter.

According to one embodiment of the invention service profiles specific to a call terminal are configured in the control system, in which service profiles e.g. the following are set:

- the floors to which a passenger can give destination calls from the call terminal. By restricting calls to certain floors the access control of the building can be improved, and at the same time a passenger can be prevented from inadvertently traveling to a "wrong" floor,
- the language with which passengers are guided or given other information in connection with giving a call. The language selection can be pertinent e.g. when a group of tourists, or other corresponding group, belonging to a certain language group arrives in a building,
- user group, on the basis of which the operation of the call terminal or of the elevator allocated to the call of the call terminal is adapted taking into account the special needs of the user group. If, for example, a group of elderly people arrives in the building, a call terminal can be reserved for their use, registered calls from which call terminal lengthen the normal door times of the allocated elevator, change the run profile of the elevator car to be "softer", lengthen the assumed walking times, activate auditive guidance, etc.
- a message or other information, which is presented to a passenger on the display of the call terminal and/or auditively e.g. in connection with the giving of a call. The information can be connected to e.g. a conference or other current event that is taking place in the building at the time,
- elevators and/or elevator groups, which serve registered calls from the call terminal in question. By placing call terminals in locations that are critical from the viewpoint of traffic and by directing calls to the elevators/elevator groups that are optimal from the viewpoint of traffic, congestion of the elevator lobbies can be reduced and at the same time the transport capacity of the elevator system can be improved. One or more elevators from the elevator system can be reserved for a certain transport service, e.g. for freight transport, in which case other traffic is not disturbed by freight transport.

The elevator system can thus comprise a number of elevator groups, to which calls can be conveyed from a portable call terminal and passengers can be guided to the elevator/elevator group serving them. A number of portable call terminals can also be disposed on the same floor level, from which call terminals calls can be given either to the same elevators/elevator groups or from a specific call terminal to only certain elevators/elevator groups.

When the solution according to the invention is applied to the modernizations of elevators, portable call terminals are disposed on the floor levels that the elevators being modernized serve. The call terminals are wirelessly connected to the new control system, e.g. to a new group control, which via a suitable interface controls the elevators that are being modernized. When the modernization progresses the portable call terminals are removed from the floor levels as the final (modernized) call terminals are installed on the floor levels, at the latest in the final stage of the modernization. If the customer does not want call terminals that are permanently installed, or if it is only desired to raise the transport capacity of the elevator system by switching from up/down calls to destination calls, the portable call terminals can be left on the floor levels as a part of the modernization delivery. A reason for leaving call terminals can also be that the customer wants to keep the building in as original a condition as possible without interfering with structures (cf protected buildings).

It is obvious to the person skilled in the art that the invention is not limited solely to the examples described above, but that it may be varied within the scope of the claims presented below. It is further obvious to the person skilled in the art that the different phases of the method can be in a different sequence to each other than what is described above and, there can be a different number of phases than what is presented above.

The invention claimed is:

1. A method for adapting control functions in an elevator system, the elevator system including at least one elevator, at least one freely locatable call terminal configured to register destination calls from multiple passengers, and a control system responsive to the at least one freely locatable call terminal, the method comprising:

setting a value of at least one control parameter based on a calculated distance between the at least one freely locatable call terminal and the at least one elevator within a building; and controlling the elevator system based on the at least one control parameter.

2. The method according to claim 1, further comprising:

determining position data for the at least one freely locatable call terminal; and wherein the value of the at least one control parameter is set based on the position data.

3. The method according to claim 2, wherein the position data is determined automatically by a position location system.

4. The method according to claim 2, further comprising:

guiding a passenger to at least one of the elevator and an elevator group serving the passenger based on the position data for the at least one freely locatable call terminal.

5. The method according to claim 1, further comprising:

setting a service profile to be connected to the at least one freely locatable call terminal; and at least one of allocating a call from the at least one freely locatable call terminal and controlling an elevator allocated to the call based on the service profile.

6. The method according to claim 1, wherein the at least one freely locatable call terminal is connected to the elevator system during modernization of the elevator system.

7. The method according to claim 6, further comprising:

installing fixed call-giving appliances on at least one floor level; and removing the at least one freely locatable call terminal from the floor level.

8. An elevator system comprising:

at least one elevator;

at least one freely locatable call terminal that registers destination calls from multiple passengers; and a control system that, responsive to the at least one freely locatable call terminal, controls the elevator system based on at least one control parameter, a value of the at least one control parameter being determined based on a calculated distance between the at least one freely locatable call terminal and the at least one elevator within a building after the at least one freely locatable call terminal is arranged at the location in the building.

9. The elevator system according to claim 8, further comprising:

a position location system that determines position data for the at least one freely locatable call terminal; and wherein the control system sets the value of the at least one control parameter based on the position data.

10. The elevator system according to claim 9, wherein the position location system determines the position data for the at least one freely locatable call terminal automatically.

11. The elevator system according to claim 9, wherein the elevator system provides guidance information to a passenger, the guidance information being determined based on the position data for the at least one freely locatable call terminal.

12. The elevator system according to claim 8, wherein the elevator system records a service profile to be connected to the at least one freely locatable call terminal, and wherein the control system at least one of allocates a call from the at least one freely locatable call terminal and controls an elevator allocated to the call based on the service profile.

13. The elevator system according to claim 8, wherein the at least one freely locatable call terminal is connected to the elevator system during modernization of the elevator system.

14. The elevator system according to claim 8, the elevator system is a modernized elevator system.

15. The method of claim 1, wherein the at least one freely locatable call terminal registers destination calls from multiple passengers concurrently.

16. The elevator system of claim 8, wherein the at least one freely locatable call terminal registers destination calls from multiple passengers concurrently.

* * * * *